US011658446B2

(12) United States Patent
Koyama et al.

(10) Patent No.: US 11,658,446 B2
(45) Date of Patent: May 23, 2023

(54) RELAY CONNECTOR AND BUSBAR

(71) Applicant: J.S.T. MFG. CO., LTD., Tokyo (JP)

(72) Inventors: Shozaburo Koyama, Osaka (JP); Yuto Mantani, Osaka (JP)

(73) Assignee: J.S.T. MFG. CO., LTD., Tokyo (JP)

( * ) Notice: Subject to any disclaimer, the term of this patent is extended or adjusted under 35 U.S.C. 154(b) by 0 days.

(21) Appl. No.: 17/548,360

(22) Filed: Dec. 10, 2021

(65) Prior Publication Data

US 2022/0200221 A1 Jun. 23, 2022

(30) Foreign Application Priority Data

Dec. 18, 2020 (JP) ..... JP2020-210181

(51) Int. Cl.
*H01R 31/06* (2006.01)
*H01R 13/04* (2006.01)
(Continued)

(52) U.S. Cl.
CPC ..... *H01R 31/06* (2013.01); *H01R 13/04* (2013.01); *H01R 13/41* (2013.01); *H01R 13/20* (2013.01);
(Continued)

(58) Field of Classification Search
CPC .... H01R 25/162; H01R 25/161; H01R 13/02; H01R 13/20; H01R 13/04; H01R 13/502;
(Continued)

(56) References Cited

U.S. PATENT DOCUMENTS 8,587,931 B2 * 11/2013 Shiraiwa ..... H05K 1/0263 361/752
9,106,010 B2 * 8/2015 Jimbo ..... H01R 9/226
(Continued)

FOREIGN PATENT DOCUMENTS

JP 2012-99249 A 5/2012

*Primary Examiner* — Briggitte R. Hammond
(74) *Attorney, Agent, or Firm* — Kratz, Quintos & Hanson, LLP

(57) ABSTRACT

A relay connector connects a plurality of front female terminals that are fitted from a front side in a front-rear direction and a plurality of rear female terminals that are fitted from a rear side in the front-rear direction together. The relay connector includes a housing and a busbar. The housing includes a front insertion recess portion, a rear insertion recess portion, an intermediate wall portion, and a busbar holding portion disposed at the intermediate wall portion. The busbar includes a base portion, a rear tab, an extension portion extending from the base portion to the same side in an up-down direction, and a front tab extending from an extension end of the extension portion to the front-insertion-recess-portion side. The rear tab includes a rear held portion adjacent to the base portion and a rear male terminal portion housed in the rear insertion recess portion. The front tab includes a front held portion adjacent to the extension end of the extension portion and a front male terminal portion housed in the front insertion recess portion. The busbar holding portion includes a first holding portion that holds the rear held portion of the rear tab, a second holding portion that holds the front held portion of the front tab, and a third holding portion that holds the extension portion.

9 Claims, 9 Drawing Sheets

(51) Int. Cl.

| | |
|---|---|
| ***H01R 13/506*** | (2006.01) |
| ***H01R 13/20*** | (2006.01) |
| ***H01R 13/50*** | (2006.01) |
| ***H01R 25/16*** | (2006.01) |
| ***H01R 13/41*** | (2006.01) |

(52) U.S. Cl.
CPC ..... *H01R 13/50* (2013.01); *H01R 13/506* (2013.01); *H01R 25/162* (2013.01)

(58) Field of Classification Search
CPC ..... H01R 13/506; H01R 13/41; H01R 13/50; H01R 13/40; H01R 31/005; H01R 31/06
See application file for complete search history.

(56) References Cited

U.S. PATENT DOCUMENTS

| | | | | |
|---|---|---|---|---|
| 9,148,964 | B2 * | 9/2015 | Hattori | B60R 16/0238 |
| 9,774,155 | B2 * | 9/2017 | Shimizu | H01R 13/41 |
| 10,232,810 | B2 * | 3/2019 | Okumura | H02G 3/16 |

* cited by examiner

RELAY CONNECTOR AND BUSBAR

CROSS REFERENCE TO RELATED APPLICATION

This application corresponds Japanese Patent Application No. 2020-210181 filed in the Japan Patent Office on Dec. 18, 2020, the entire disclosure of which incorporated herein by reference.

BACKGROUND OF THE INVENTION

Field of the Invention

The present invention relates to a relay connector and a busbar that is used in this relay connector.

Description of Related Arts

In a joint connector disclosed by Japanese Laid-Open Patent Publication No. 2012-99249, a busbar that has a plate-shaped main body portion and a plurality of male terminal portions extending from two sides, which face each other, of the main body portion is used as a busbar that is inserted and removed with respect to a female terminal from both sides in a front-rear direction.

In the busbar, the main body portion and the male terminal portions are disposed on the same plane, and therefore a holding force for holding the busbar in a housing becomes low. Therefore, in order to make the holding force high, it is conceivable that the length in the front-rear direction of a portion that holds the busbar is lengthened. However, if the length in the front-rear direction of the portion that holds the busbar is lengthened, a joint connector (which corresponds to a relay connector) is enlarged.

SUMMARY OF THE INVENTION

One preferred embodiment of the present invention provides a relay connector that is small in size and that has a high holding force by which a busbar is held, and provides a busbar that is used in this relay connector.

One preferred embodiment of the present invention provides a relay connector that connects a plurality of front female terminals, which are fitted from a front in a front-rear direction, and a plurality of rear female terminals, which are fitted from a rear in the front-rear direction, together and that includes a housing and a busbar. The housing includes a plurality of front insertion recess portions that are disposed so as to be arrayed in a right-left direction and into which the front female terminals are respectively inserted, a plurality of rear insertion recess portions that are disposed so as to be arrayed in the right-left direction and into which the rear female terminals are respectively inserted, an intermediate wall portion that divides the front insertion recess portion and the rear insertion recess portion from each other in the front-rear direction, and a busbar holding portion that is disposed at the intermediate wall portion. The busbar includes a base portion that extends in the right-left direction, a plurality of rear tabs that extend from the base portion to the rear insertion recess portion, a plurality of extension portions each of which extends from the base portion to a same side in an up-down direction, and a plurality of front tabs each of which extends from an extension end of each of the extension portions to a corresponding one of the front insertion recess portions. Each of the rear tabs includes a rear held portion adjacent to the base portion and a rear male terminal portion that is housed in the rear insertion recess portion. Each of the front tabs includes a front held portion adjacent to the extension end of the extension portion and a front male terminal portion that is housed in the front insertion recess portion. The busbar holding portion includes a plurality of first holding portions which respectively hold the rear held portions the rear tabs, a plurality of second holding portions which respectively hold the front held portions of the front tabs, and a plurality of third holding portions which respectively hold the extension portions.

According to this configuration, the busbar holding portion of the housing includes the first holding portion, the second holding portion, and the third holding portion. In the busbar, the rear held portion of the rear tab held by the first holding portion, the front held portion of the front tab held by the second holding portion, and the extension portion held by the third holding portion are disposed in a crank shape, and their crank-shaped portions are connected together through the base portion. Therefore, it is possible to realize a relay connector having a high holding force by which the busbar is held even if the relay connector is small in size.

In one preferred embodiment, each of the first holding portions includes a press-fit hole that passes through the intermediate wall portion and into which a corresponding one of the rear held portions is press-fitted and fixed. According to this configuration, the rear held portion of the rear tab is press-fitted and fixed into the press-fit hole serving as the first holding portion, and therefore the busbar is firmly fixed particularly in the front-rear direction.

In one preferred embodiment, each of the second holding portions includes a second holding groove that is disposed at a wall surface, which is closer to the front insertion recess portion, of the intermediate wall portion and that holds a corresponding one, which has been fitted in the second holding groove, of the front held portions, and the second holding groove is formed in a shape including a pair of inner wall surfaces that face each other in the up-down direction and that position and hold the front held portion in the up-down direction.

According to this configuration, the front held portion of the front tab is fitted and held by the second holding groove serving as the second holding portion disposed at the wall surface, which is closer to the front insertion recess portion, of the intermediate wall portion. The front held portion is positioned and held by the pair of inner wall surfaces of the second holding groove in the up-down direction. The busbar is positioned and held in the up-down direction by use of the front held portion.

In one preferred embodiment, each of the front held portions includes a pair of protruding portions that protrude to both sides in the right-left direction, and is formed in a cross shape when seen in the up-down direction. According to this configuration, the busbar is firmly positioned and held in the up-down direction by use of the front held portion assuming the cross shape.

In one preferred embodiment, each of the third holding portions includes an abutting portion that is disposed at a wall surface, which is closer to the front insertion recess portion, of the intermediate wall portion and against which a corresponding one of the extension portions is abutted. According to this configuration, the extension portion is abutted against the abutting portion (third holding portion) disposed at the wall surface, which is closer to the front insertion recess portion, of the intermediate wall portion.

Therefore, it is possible to highly accurately position and hold the busbar in the front-rear direction by use of the extension portion.

In one preferred embodiment, each of the third holding portions includes a third holding groove that is disposed at the wall surface, which is closer to the front insertion recess portion, of the intermediate wall portion and that holds a corresponding one, which has been fitted to the third holding groove, of the extension portions, and the third holding groove is formed in a shape including a grooved bottom surface serving as the abutting portion and a pair of inner wall surfaces that face each other in the right-left direction and that position and hold a corresponding one of the extension portions in the right-left direction.

According to this configuration, the extension portion is fitted and held by the third holding groove serving as the third holding portion disposed at the wall surface, which is closer to the front insertion recess portion, of the intermediate wall portion. The extension portion is positioned and held by the pair of inner wall surfaces of the third holding groove in the right-left direction, and the extension portion is positioned and held by the grooved bottom surface of the third holding groove in the front-rear direction. Hence, the busbar is positioned and held in the front-rear direction and in the right-left direction by use of the extension portion.

In one preferred embodiment, a plurality of the busbars are disposed so as to be arrayed in the right-left direction, the housing includes a plurality of busbar housing portions that are disposed so as to be arrayed in the right-left direction and into each of which a corresponding one of the busbars is inserted and disposed from the front, each of the busbar housing portions is defined by a pair of partition wall portions that face each other in the right-left direction and by a pair of wall portions that face each other in the up-down direction, and the base portions of the busbars housed in the busbar housing portions adjacent in the right-left direction are insulated from each other by the partition wall portion interposed between the base portions. According to this configuration, the base portions of the busbars adjacent to each other are prevented from being short-circuited.

In one preferred embodiment, a pair of guide grooves that respectively receive and guide a pair of tips in the right-left direction of the base portion of a corresponding one of the busbars in the front-rear direction are respectively formed at a pair of corner portions that join the pair of partition wall portions and one of the pair of wall portions together.

According to this configuration, when the busbar is incorporated from the front-insertion-recess-portion side, the pair of tips in the right-left direction of the base portion of the busbar are inserted and guided by the pair of guide grooves of the pair of partitioning walls, and therefore it is possible to easily assemble the relay connector.

One preferred embodiment of the present invention provides a busbar that is used in a relay connector, the busbar including a base portion that extends in a right-left direction, a plurality of rear tabs that extend rearwardly from the base portion in a front-rear direction, a plurality of extension portions each of which extends from the base portion to a same side in an up-down direction, and a plurality of front tabs each of which extends from an extension end of each of the extension portions to a front in the front-rear direction. Each of the rear tabs includes a rear held portion adjacent to the base portion and a rear male terminal portion. Each of the front tabs includes a front held portion adjacent to the extension end and a front male terminal portion. According to this configuration, it is possible to provide a busbar that is capable of being suitably used in the relay connector, and the relay connector is enabled to fulfill the effects mentioned above.

DETAILED DESCRIPTION OF THE PREFERRED EMBODIMENT

A preferred embodiment in which the present invention is embodied will be hereinafter described with reference to the drawings.

Figure 1:
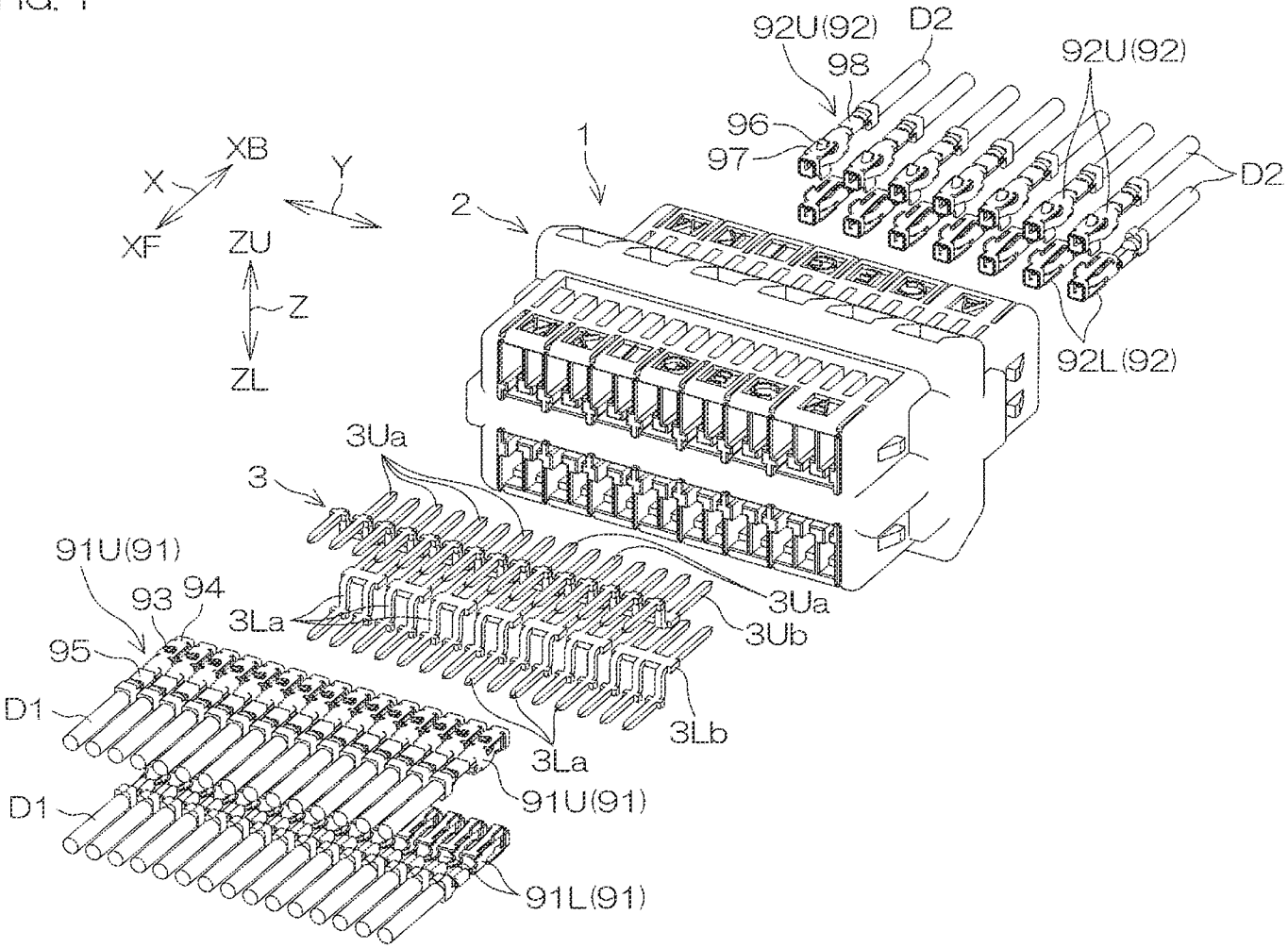
FIG. 1 is an exploded perspective view of a relay connector and a female terminal of a preferred embodiment of the present invention.

FIG. 1 is an exploded perspective view of a relay connector and a female terminal of a preferred embodiment of the present invention. As shown in FIG. 1, the relay connector 1 is a relay connector that connects a plurality of front female terminals 91 that are fitted from the rear XB in the front-rear direction X (i.e., toward the front XF) and a plurality of rear female terminals 92 that are fitted from the front XF in the front-rear direction X (i.e., toward the rear XB) together.

The front female terminal 91 includes an angularly cylindrical main body portion 94 having a lance 93 and an electric-wire connection portion 95 to which an electric wire D1 is connected. The rear female terminal 92 includes an angularly cylindrical main body portion 97 having a lance 96 and an electric-wire connection portion 98 to which an electric wire D2 is connected. In the following description, the front-rear direction X, the right-left direction Y, and the up-down direction Z are described as three directions that perpendicularly intersect each other.

The relay connector 1 is composed of a housing 2 and a plurality of busbars 3 disposed so as to be arrayed in the right-left direction Y.

The busbar 3 will be first described with reference to FIG. 1, FIG. 2A, and FIG. 2B.

As shown in FIG. 1, the busbar 3 includes an upper row busbar 3U and a lower row busbar 3L that are arrayed in upper and lower two rows.

The upper row busbar 3U includes, for example, two kinds of upper row busbars 3Ua (see FIG. 2A) and 3Ub (see FIG. 2B) as a plurality of kinds of busbars that differ in specifications from each other. The lower row busbar 3L includes, for example, two kinds of lower row busbars 3La and 3Lb as a plurality of kinds of busbars that differ in specifications from each other. The upper row busbar 3Ua, the upper row busbar 3Ub, the lower row busbar 3La, and the lower row busbar 3Lb are referred to simply as the busbar 3 if it is necessary to collectively represent these busbars.

In an example shown in FIG. 1, in the upper row busbar 3Ua that is one of the upper row busbars 3Ua and 3Ub, for example, six busbars are arranged in the right-left direction Y from a left end position in the right-left direction Y. Additionally, in the other upper row busbar 3Ub, for example, a single busbar is disposed at a right end position in the right-left direction Y. Likewise, in the lower row busbar 3La that is one of the lower row busbars 3La and 3Lb, for example, six busbars are arranged in the right-left direction Y from a left end position in the right-left direction Y. Additionally, in the other lower row busbar 3Lb, for example, a single busbar is disposed at a right end position in the right-left direction Y.

The upper row busbar 3Ua and the lower row busbar 3La are up-downwardly symmetrical in shape, and common members are used in a state of being mutually opposite in direction. Additionally, the other upper row busbar 3Ub and the other lower row busbar 3Lb are up-downwardly symmetrical in shape, and common members are used in a state of being mutually opposite in direction.

Therefore, in the following description, the upper row busbar 3U (3Ua, 3Ub) is described, and a description of the lower row busbar 3L (3La, 3Lb) is omitted.

Figure 2A:
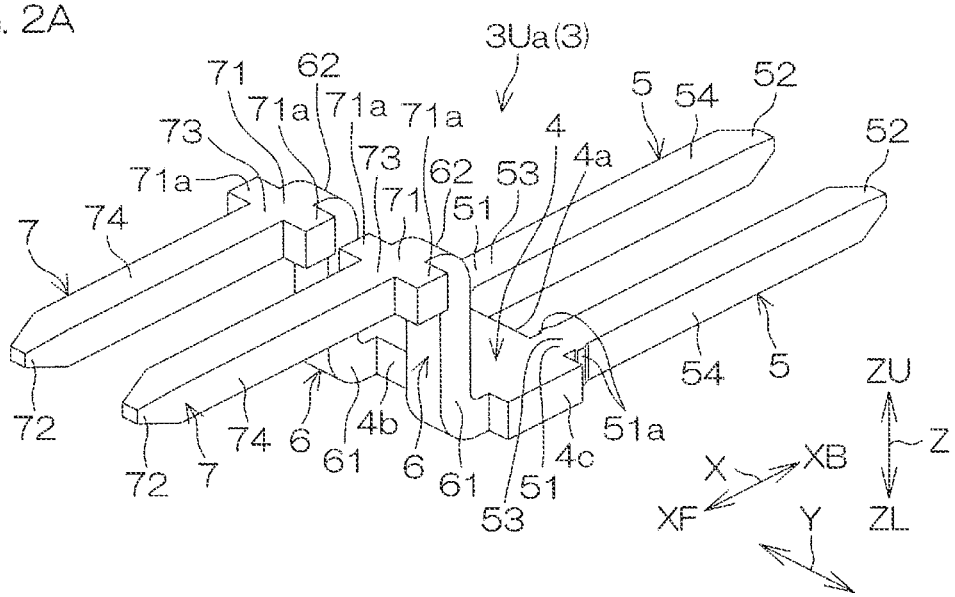
FIG. 2A is a perspective view of a first busbar.

As shown in FIG. 2A, the upper row busbar 3Ua includes a base portion 4, two rear tabs 5, two extension portions 6, and two front tabs 7.

The base portion 4 is a rectangular plate-shaped portion extending in the right-left direction Y. The base portion 4 includes a rear end edge 4*a*, a front end edge 4*b*, and a pair of tips 4*c* in the right-left direction Y (see also FIG. 9A). The two rear tabs 5 are away from each other in the right-left direction Y, and extend from the rear end edge 4*a* of the base portion 4 to the rear XB in parallel in the front-rear direction X.

Each of the rear tabs 5 is a segmental portion having an angulated cross section, and includes a base end portion 51, a forward end portion 52, a rear held portion 53, and a rear male terminal portion 54. The base end portion 51 is connected to the base portion 4. The forward end portion 52 is formed in a tapered shape. The rear held portion 53 is a part adjacent to the rear end edge 4*a* of the base portion 4, and is a part including the base end portion 51. In detail, the rear held portion 53 includes the base end portion 51 and a press-fit projection 51*a* that protrudes from the base end portion 51 to both sides in the right-left direction Y. The rear male terminal portion 54 is a part, which is closer to the forward end portion 52 than to the rear held portion 53, of the rear tab 5, and is a part that is fitted and connected to the rear female terminal 92.

Each of the extension portions 6 is a segmental portion extending from the front end edge 4*b* of the base portion 4 to the upper side ZU in the up-down direction Z. Each of the extension portions 6 includes a base end 61 that is connected to the base portion 4 and an extension end 62.

Each of the front tabs 7 extends from the extension end 62 (i.e., the upper end) of a corresponding extension portion 6 to the front side XF in the front-rear direction X. Each of the front tabs 7 is a segmental portion having an angulated cross section, and includes a base end portion 71, a forward end portion 72, a front held portion 73, and a front male terminal portion 74. The base end portion 71 is connected to the extension end 62 of a corresponding extension portion 6. The forward end portion 72 is formed in a tapered shape.

The front held portion 73 is a part that is adjacent to the front XF of the extension end 62 and that includes the base end portion 71. In detail, the front held portion 73 includes the base end portion 71 and a pair of right-left-direction protruding portions 71*a* that protrude from the base end portion 71 to both sides in the right-left direction Y, and is formed in a cross shape. The front male terminal portion 74 is a part, which is closer to the forward end portion 72 than to the front held portion 73, of the front tab 7, and that is fitted and connected to the front female terminal 91.

Figure 2B:
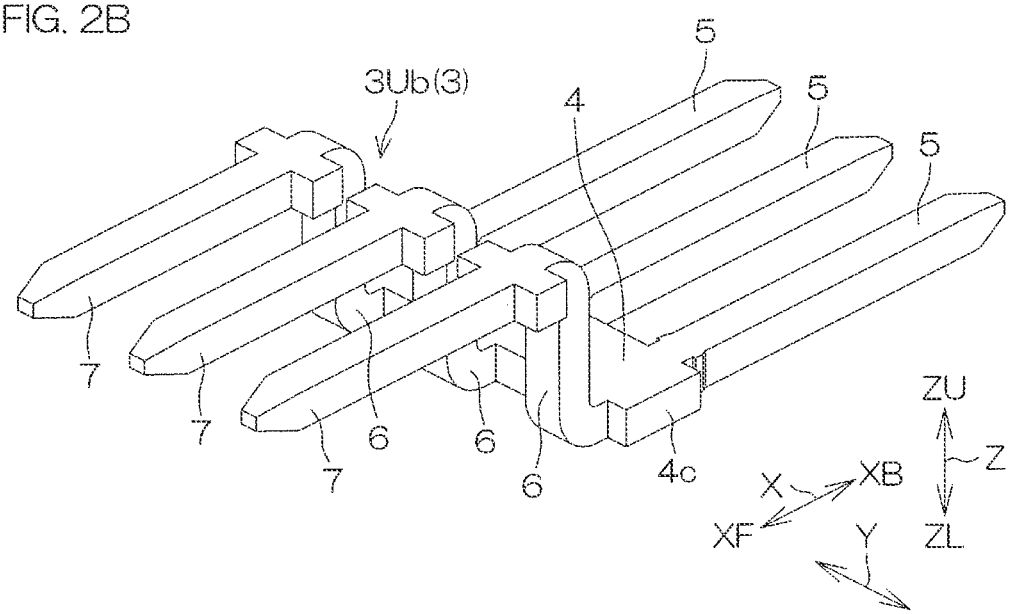
FIG. 2B is a perspective view of a second busbar.

As shown in FIG. 2B, the other upper row busbar 3Ub includes the base portion 4, three rear tabs 5, three extension portions 6, and three front tabs 7. The other upper row busbar 3Ub is configured to be larger by one in the number of the rear tabs 5, in the number of the extension portions 6, and in the number of the front tabs 7 than the upper row busbar 3Ua.

Next, the housing 2 will be described.

Figure 3A:
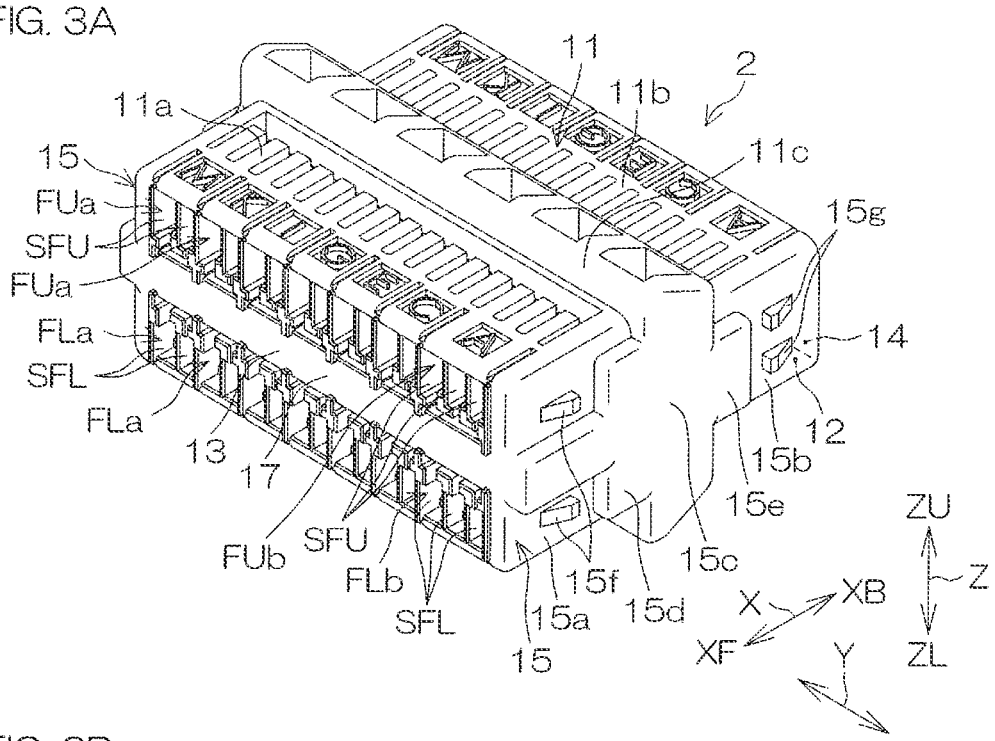
FIG. 3A is a perspective view of the relay connector.
Figure 3B:
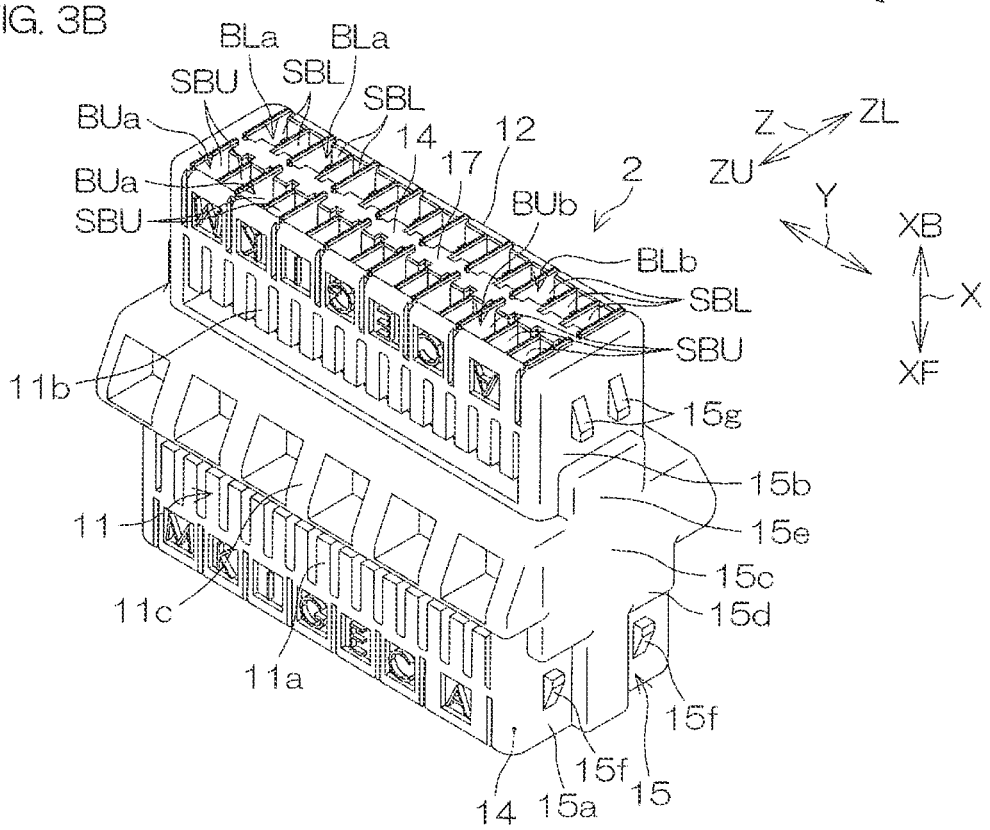
FIG. 3B is a perspective view of the relay connector seen from another angle.
Figure 4:
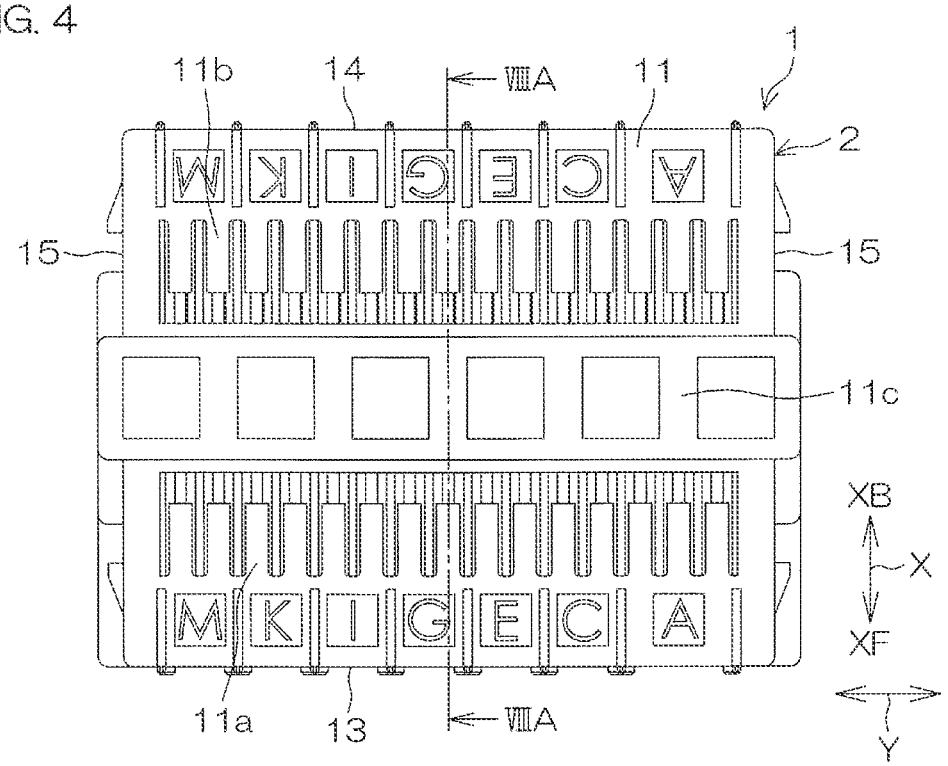
FIG. 4 is a plan view of the relay connector.
Figure 5:
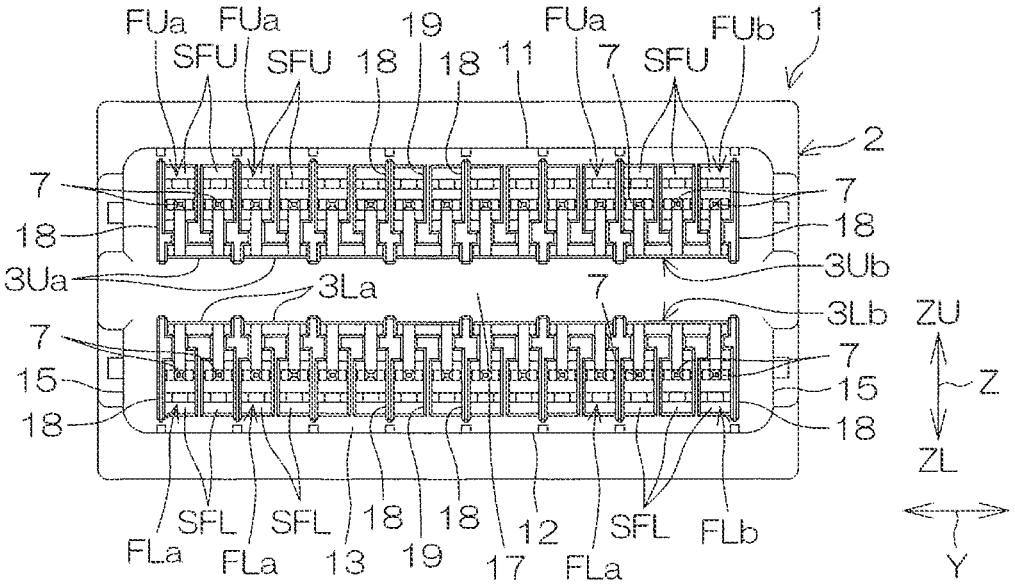
FIG. 5 is a front view of the relay connector.
Figure 6:
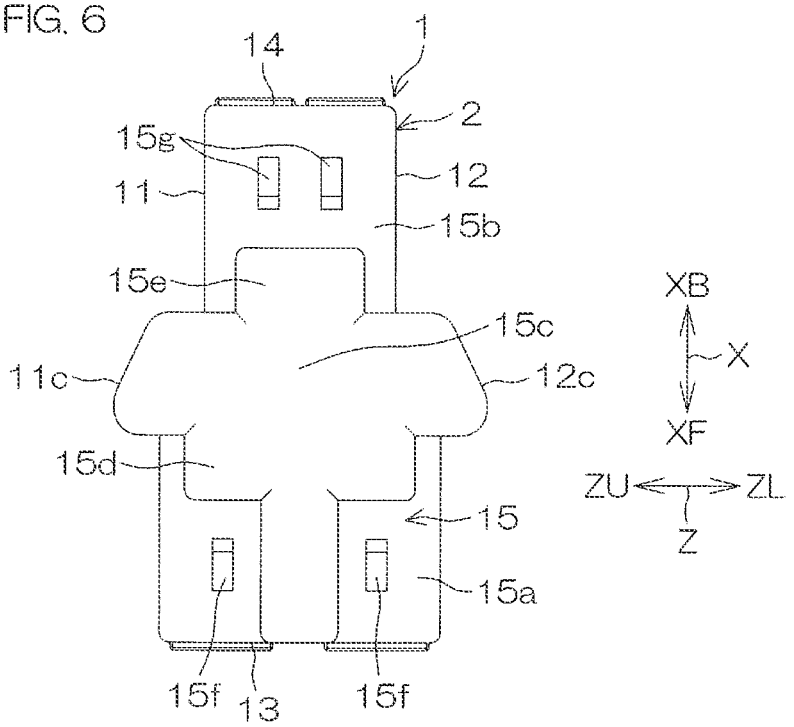
FIG. 6 is a side view of the relay connector.
Figure 7:
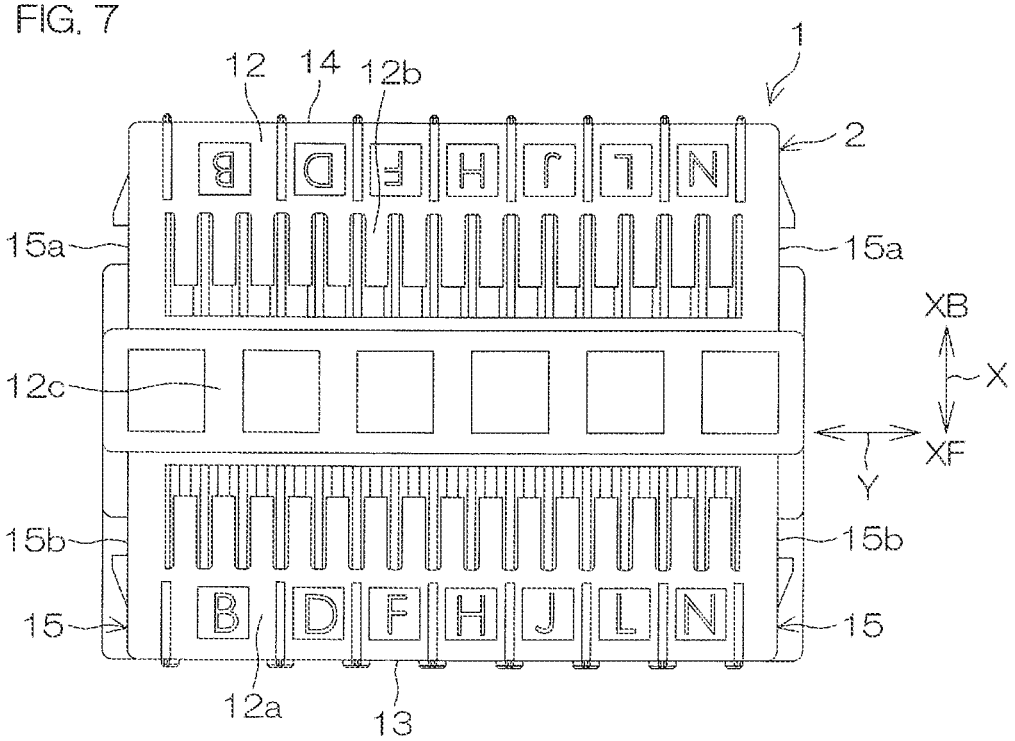
FIG. 7 is a bottom view of the relay connector.
Figure 8A:
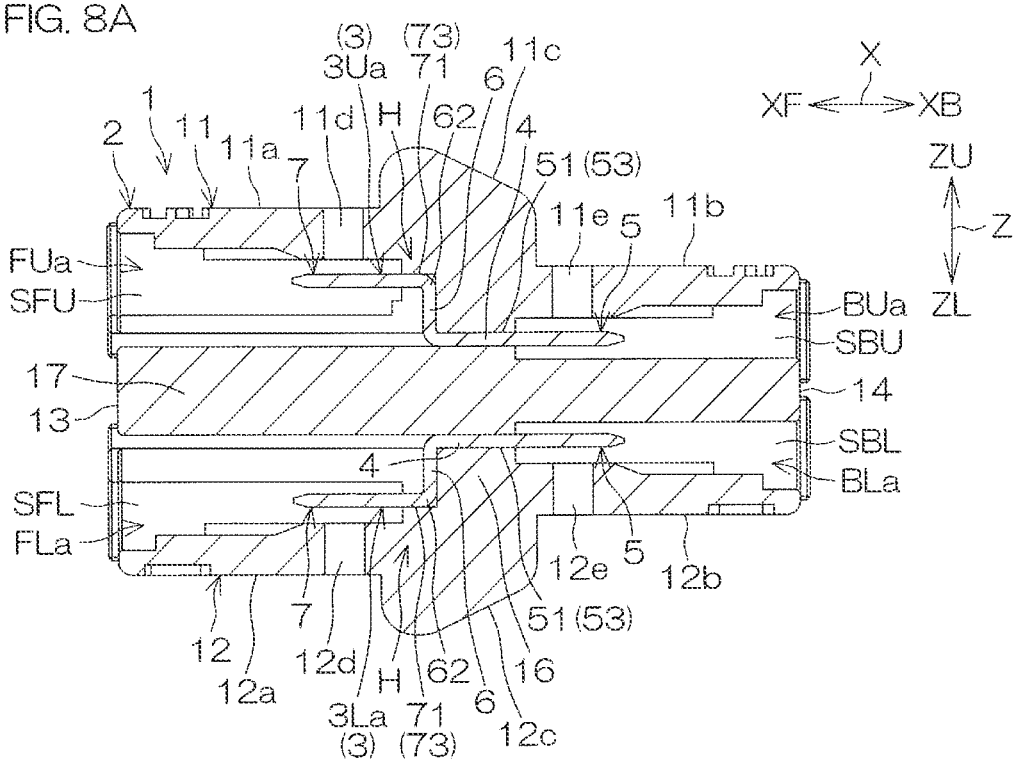
FIG. 8A is a cross-sectional view of the relay connector, which corresponds to a cross-sectional view along line VIIIA-VIIIA of FIG. 4.
Figure 8B:
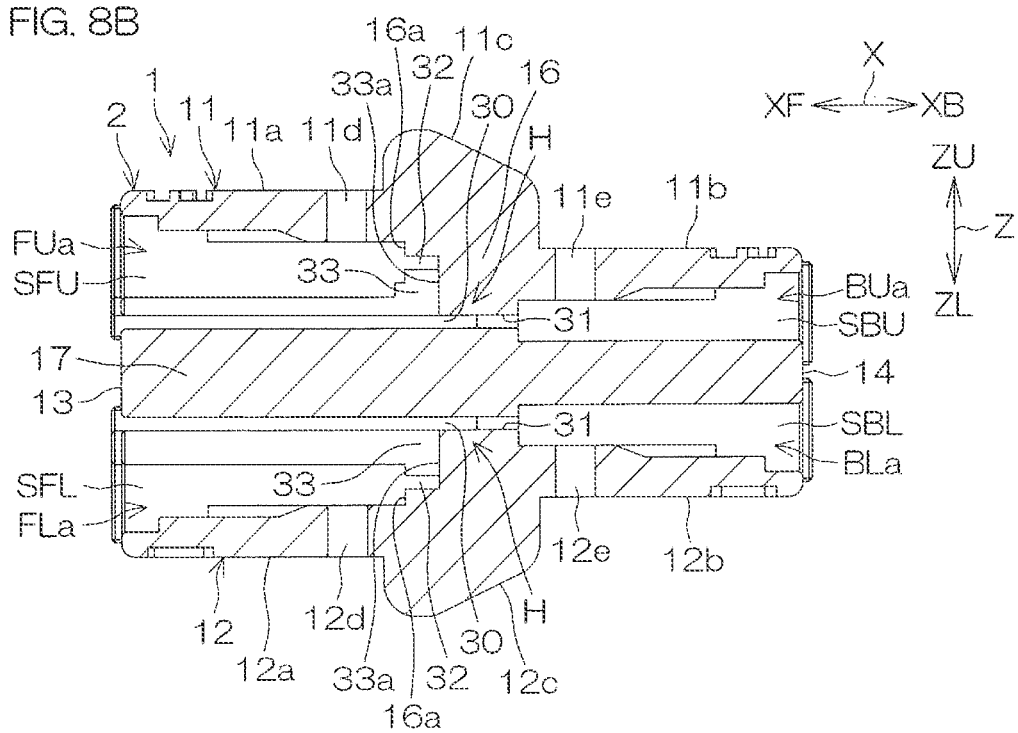
FIG. 8B is a cross-sectional view of a housing corresponding to FIG. 8A.
Figure 9A:
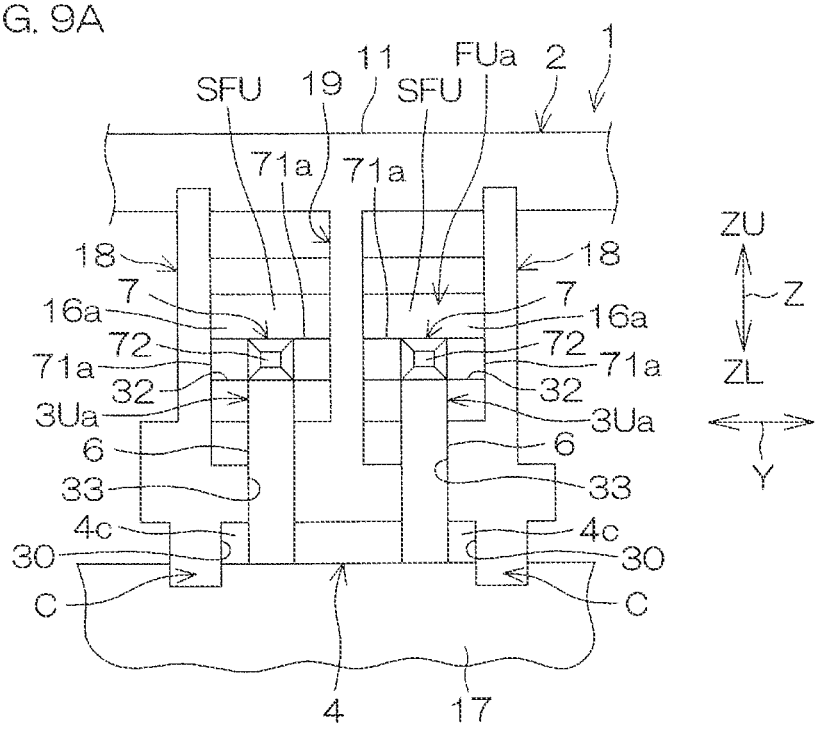
FIG. 9A is a front enlarged view of a main portion of the relay connector, which corresponds to an enlarged view of a part of FIG. 5.
Figure 9B:
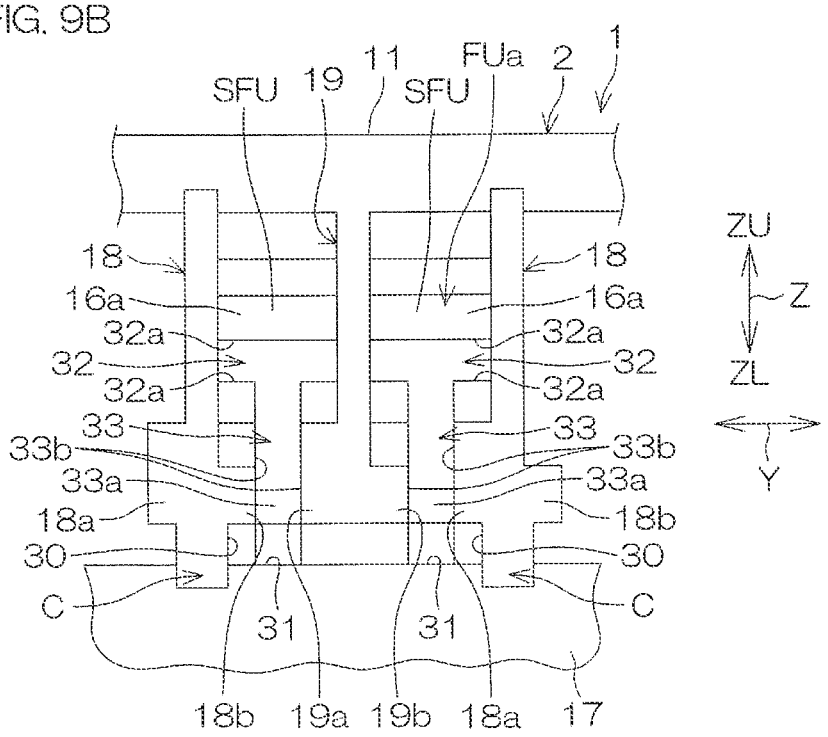
FIG. 9B is a front enlarged view of a main portion of the housing, which corresponds to FIG. 9A.
Figure 10:
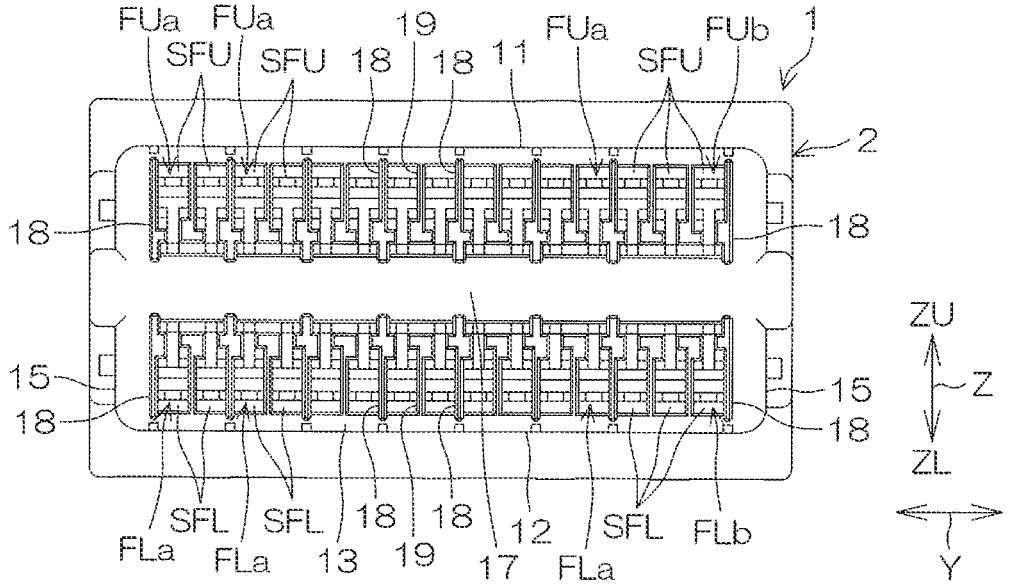
FIG. 10 is a plan view of the housing.
Figure 11:
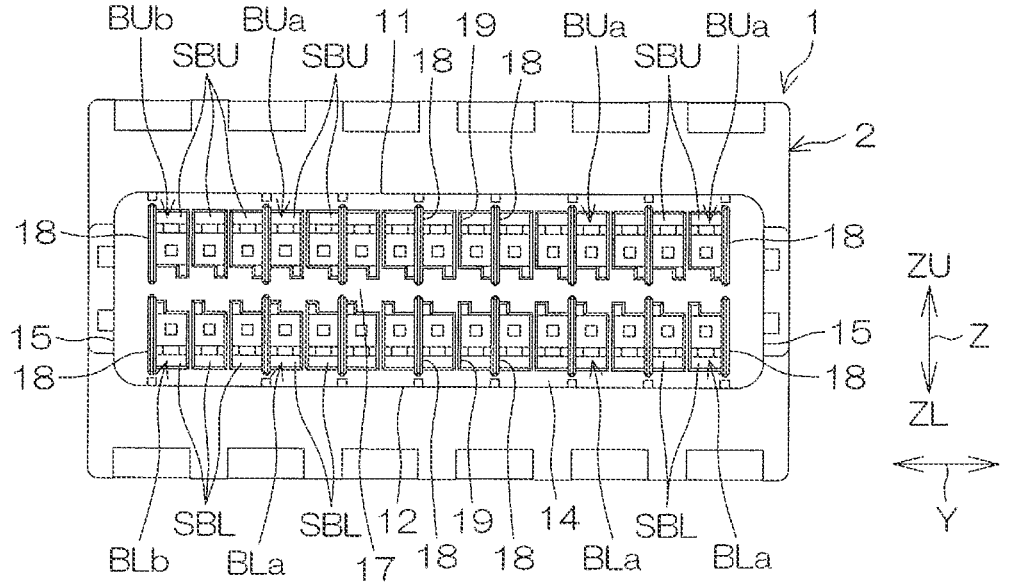
FIG. 11 is a rear view of the housing.

FIG. 3A is a perspective view of the relay connector 1, and FIG. 3B is a perspective view of the relay connector 1 seen from another angle than FIG. 3A. FIG. 4 is a plan view of the relay connector 1. FIG. 5 is a front view of the relay connector 1. FIG. 6 is a side view of the relay connector 1. FIG. 7 is a bottom view of the relay connector 1. FIG. 8A is a cross-sectional view of the relay connector 1, which corresponds to a cross-sectional view along line VIIIA-VIIIA of FIG. 4. FIG. 8B is a cross sectional view of the housing 2 corresponding to FIG. 8A. FIG. 9A is a front enlarged view of a main portion of the relay connector 1, which corresponds to an enlarged view of a part of FIG. 5. FIG. 9B is a front enlarged view of a main portion of the housing 2, which corresponds to FIG. 9A. FIG. 10 is a plan view of the housing 2. FIG. 11 is a rear view of the housing 2.

Referring to FIG. 3A, FIG. 3B, and FIG. 4 to FIG. 7, the housing 2 includes a ceiling wall portion 11, a bottom wall portion 12, a front wall portion 13, rear wall portion 14, a pair of sidewall portions 15, a front-rear-direction intermediate wall portion 16 (see FIG. 8A and FIG. 8B), and an up-down-direction intermediate wall portion 17 (see FIG. 8A and FIG. 8B). The housing 2 additionally includes a partition wall portion 18 (see FIG. 9A and FIG. 9B), a partially-dividing wall portion 19 (see FIG. 9A and FIG. 9B), a plurality of front busbar-housing portions F, a plurality of rear busbar-housing portions B, and a plurality of busbar holding portions H. The housing 2 is integrally molded by an insulating synthetic resin material. The front busbar-housing portion F is a collective term for an upper-row front busbar-housing portion FU and lower-row front busbar-housing portion FL described later. The rear busbar-housing portion B is a collective term for an upper-row rear busbar-housing on BU and a lower-row rear busbar-housing portion BL described later.

The ceiling wall portion 11 includes a front portion 11*a*, a rear portion 11*b*, an intermediate protruding portion 11*c*, a front locking hole 11*d*, and a rear locking hole 11*e*. The bottom wall portion 12 includes a front portion 12*a*, a rear portion 12*b*, an intermediate protruding portion 12*c*, a front locking hole 12*d*, and a rear locking hole 12*e*. The sidewall portion 15 includes a front portion 15*a*, a rear portion 15*b*, an intermediate protruding portion 15*c*, a front extension protruding portion 15*d*, a rear extension protruding portion 15*e*, a pair of locking projections 15*f*, and a pair of locking projections 15*g*.

The intermediate protruding portion 11*c* of the ceiling wall portion 11, the intermediate protruding portion 12*c* of the bottom wall portion 12, and the intermediate protruding portion 15*c* of the sidewall portion 15 are annularly continuous with each other. The lance 93 of the front female terminal 91 and the lance 96 of the rear female terminal 92 (see FIG. 1) are locked into each of the front locking holes 11*d* and 12*d* and each of the rear locking holes 11*e* and 12*e*, respectively.

The front busbar-housing portion F, the rear busbar-housing portion B, and the busbar holding portion H are each disposed so as to be the same in number as the busbar 3.

A plurality of front busbar-housing portions F are arrayed in the right-left direction Y, and the busbar 3 corresponding to each of the front busbar-housing portions F is disposed in a state of having been inserted therein from the front XF. Each of the front busbar-housing portions F houses the front portion (the front male terminal portion 74 of the front tab 7) of the busbar 3 corresponding thereto. Each of the rear busbar-housing portions B houses the rear portion (the rear male terminal portion 54 of the rear tab 5) of the busbar 3 corresponding thereto. Each of the busbar holding portions H holds the intermediate portion (the rear held portion 53, the base portion 4, and the front held portion 73) in the front-rear direction X of the busbar 3 corresponding thereto.

The front busbar-housing portion F is configured such that a plurality of housing portions F are arranged in the right-left direction Y so as to form a row and such that two lines of housing portions F (i.e., two lines consisting of the upper-row front busbar-housing portion FL) and the lower-row front busbar-housing portion FL) are arranged in the up-down direction Z. The upper-row front busbar-housing portion FU and the lower-row front busbar-housing portion FL are referred to simply as the front busbar-housing portion F if it is necessary to collectively represent these busbar-housing portions.

The upper-row front busbar-housing portion EU includes one upper-row front busbar-housing portion FUa, which houses the front portion of one upper row busbar 3Ua, and the other upper-row front busbar-housing portion FUb, which houses the front portion of the other upper row busbar 3Ub.

The lower-row front busbar-housing portion FL includes one lower-row front busbar-housing portion FLa, which houses the front portion of the lower row busbar 3La, and the other lower-row front busbar-housing portion FLb, which houses the front portion of the other lower row busbar 3Lb.

As shown in FIG. 5 and FIG. 10, each of the front busbar-housing portions F contains a plurality of front insertion recess portions SF. Each of the front insertion recess portions SF is open in the front wall portion 13. The front insertion recess portion SF is configured such that a plurality of insertion recess portions SF are arranged in the right-left direction Y so as to form a row and such that two lines of insertion recess portions SF (i.e., two lines consisting of an upper-row front insertion recess portion SFU and a lower-row front insertion recess portion SFL) are arranged in the up-down direction Z. The upper-row front insertion recess portion SFU and the lower-row front insertion recess portion SFL are formed so as to be up-downwardly symmetrical with respect to the up-down-direction intermediate wall portion 17 extending in the right-left direction Y when seen from the front. The upper-row front insertion recess portion SFU and the lower-row front insertion recess portion SFL are referred to simply as the front insertion recess portion SF if it is necessary to collectively represent these front insertion recess portions.

As shown in FIG. 11, the rear busbar-housing portion B is configured such that a plurality of busbar-housing portions B are arranged in the right-left direction Y so as to form a row and such that two lines of busbar-housing portions B (i.e., two lines consisting of the upper-row rear busbar-housing portion BU and the lower-row rear busbar-housing portion FL) are arranged in the up-down direction Z. The upper-row rear busbar-housing portion BU and the lower-row rear busbar-housing portion BL are referred to simply as the rear busbar-housing portion B if it is necessary to collectively represent these busbar-housing portions.

The upper-row rear busbar-housing portion BU includes one upper-row rear busbar-housing portion BUa, which houses the rear portion of the upper row busbar 3Ua, and the other upper-row rear busbar-housing portion BUb, which houses the rear portion of the other upper row busbar 3Ub.

The lower-row rear busbar-housing portion BL includes one lower-row rear busbar-housing portion BLa, which houses the rear portion of the lower row busbar 3La, and the other lower-row rear busbar-housing portion BLb, which houses the rear portion of the other lower row busbar 3Lb.

The rear busbar-housing portion B contains a plurality of rear insertion recess portions SB. The rear insertion recess portion SB is open in the rear wall portion 14. The rear insertion recess portion SB is configured such that a plurality of insertion recess portions SB are arranged in the right-left direction Y so as to form a row and such that two lines of insertion recess portions SB (i.e., two lines consisting of an upper-row rear insertion recess portion SBU and a lower-row rear insertion recess portion SBL) are arranged in the up-down direction Z. The upper-row rear insertion recess portion SBU and the lower-row rear insertion recess portion SBL are formed so as to be up-downwardly symmetrical with respect to the up-down-direction intermediate wall portion 17 extending in the right-left direction Y when seen from the rear. The upper-row rear insertion recess portion SBU and the lower-row rear insertion recess portion SBL are referred to simply as the rear insertion recess portion SB if it is necessary to collectively represent these insertion recess portions.

The upper-row front busbar-housing portion FUa and the lower-row front busbar-housing portion FLa are up-downwardly symmetrical, and therefore the upper-row front busbar-housing portion FUa is chiefly described in the following description.

As shown in FIG. 9A and FIG. 9B, each of the upper-row front busbar-housing portions FUa is defined by the pair of partition wall portions 18 and 18 that face each other in the right-left direction Y, by the ceiling wall portion 11 and the up-down-direction intermediate wall portion 17 both of which serve as a pair of wall portions that face each other in the up-down direction, and by a front wall surface 16*a* of the front-rear-direction intermediate wall portion 16. The partially-dividing wall portion 19 that extends from the ceiling wall portion 11 toward the up-down-direction intermediate wall portion 17, which is on the down side ZL, is disposed between the pair of partition wall portions 18 and 18. As shown in FIG. 5, some partition wall portions 18 are formed integrally with inner sides of the right and left sidewall portions 15.

As shown in FIG. 5, the busbars 3U housed in the upper-row front busbar-housing portions FU adjacent in the right-left direction Y (In detail, the base portions 4 with reference to FIG. 2A. In more detail, the tips 4*c* of the base portions 4) are insulated from each other with the partition wall portion 18 interposed therebetween.

As shown in FIG. 9A and FIG. 9B, the upper-row front insertion recess portion SFU is disposed between the partially-dividing wall portion 19 and each of the partition wall portions 18. The two upper-row front insertion recess portions SFU are partially divided by the partial-dividing wall portion 19 in the right-left direction Y. The lower portions of the two upper-row front insertion recess portions SFU are communicated with each other. Corresponding front male terminal portions 74 of the upper row busbar 3Ua are housed and disposed in the two upper-row front insertion recess portions SFU, respectively.

Each of the partition wall portions 18 has a protruding portion 18*a* and a protruding portion 18*b* that protrude to both sides in the right-left direction Y at a position closer to the up-down-direction intermediate wall portion 17. Additionally, the partially-dividing wall portion 19 has a protruding portion 19*a* and a protruding portion 19*b* that protrude to both sides in the right-left direction Y in its lower end portion.

A pair of guide grooves 30 are formed at a pair of corner portions C that join the pair of partition wall portions 18 and the up-down-direction intermediate wall portion 17 together. The pair of guide grooves 30 receive and guide the pair of tips 4*c* in the right-left direction Y of the base portions 4 of corresponding busbars 3, respectively, in the front-rear direction X (in the direction perpendicular to the plane of paper in FIG. 9A). One of the pair of guide grooves 30 is defined between the protruding portion 18*b* of one of the pair of partition wall portion 18 and the up-down-direction intermediate wall portion 17, and the other one of the pair of guide grooves 30 is defined between the protruding portion 18*a* of the other one of the pair of partition wall portions 18 and the up-down-direction intermediate wall portion 17.

The busbar holding portion H includes a press-fit hole 31 that serves as a first holding portion, a second holding groove 32 that serves as a second holding portion, and a third holding groove 33 that serves as a third holding portion.

The press-fit hole 31 serving as the first holding portion passes through the front-rear-direction intermediate wall portion 16 in the front-rear direction. The rear held portion 53 is pressed and fixed in the press-fit hole 31.

The second holding groove 32 is formed a the front wall surface 16*a* of the front-rear-direction intermediate wall portion 16, and extends in the right-left direction Y. The second holding groove 32 is a through-groove that passes through the front-rear-direction intermediate wall portion 16 in the front-rear direction. The second holding groove 32 holds the front held portion 73 fitted therein. The second holding groove 32 includes a pair of inner wall surfaces 32*a* that face each other in the up-down direction Z. The pair of inner wall surfaces 32*a* of the second holding groove 32 position and hold the front held portion 73 in the up-down direction Z.

The third holding groove 33 is formed at the front wall surface 16*a* of the front-rear-direction intermediate wall portion 16, and extends in the up-down direction Z. The third holding groove 33 extends in the up-down direction Z from a central portion in the right-left direction Y of the second holding groove 32 to the up-down-direction intermediate wall portion 17. The shape of the capital letter T is formed by the second holding groove 32 and the third holding groove 33. The third holding groove 33 is disposed between the protruding portion 18*b* of one of the partition wall portions 18 and the protruding portion 19*a* of the partially-dividing wall portion 19. Additionally, the third holding groove 33 is disposed between the protruding portion 18*a* of the other one of the partition wall portions 18 and the protruding portion 19*b* of the partially-dividing wall portion 19.

The third holding groove 33 holds the extension portion 6 fitted to the third holding groove 33. The third holding groove 33 includes a grooved bottom surface 33*a* and a pair of inner wall surfaces 33*b* that face each other in the right-left direction Y. The grooved bottom surface 33*a* functions as an abutting portion against which the extension portion 6 is abutted from the front, and positions the busbar 3 in the front-rear direction X by use of the extension portion 6. The pair of inner wall surfaces 33*b* positions and holds the extension portion 6 in the right-left direction Y.

In the present preferred embodiment, the following operational effects are fulfilled.

In detail, the busbar holding portion H of the housing 2 includes a first holding portion (press-fit hole 31), a second holding portion (second holding groove 32), and a third holding portion (third holding groove 33) as shown in FIG. 8A, FIG. 8B, FIG. 9A, and FIG. 9B. In the busbar 3, the rear held portion 53 of the rear tab 5 held by the first holding portion (press-fit hole 31), the front held portion 73 of the front tab 7 held by the second holding portion (second holding groove 32), and the extension portion 6 held by the third holding portion (third holding groove 33) are disposed in a crank shape (see also FIG. 2A), and their crank-shaped portions are connected together through the base portion 4. Therefore, it is possible to realize a relay connector 1 having a high holding force by which the busbar 3 is held even if the relay connector 1 is small in size.

Additionally, the rear held portion 53 of the rear tab 5 is pressed and fixed to the press-fit hole 31 serving as the first holding portion, and therefore the busbar 3 is firmly fixed particularly in the front-rear direction Z.

Additionally, the front held portion 73 of the front tab 7 is fitted and held by the second holding groove 32 serving as the second holding portion disposed at the front wall surface 16*a* (i.e., wall surface on the front-insertion-recess-portion-SF side) in the front-rear-direction intermediate wall portion 16. The front held portion 73 is positioned and held by the pair of inner wall surfaces 32*a* of the second holding groove 32 in the up-down direction Z. Hence, the busbar 3 is positioned and held in the up-down direction Z by use of the front held portion 73.

When seen in the up-down direction Z, the front held portion 73 is formed in a cross shape including the pair of right-left-direction protruding portions 71*a* that protrude to both sides in the right-left direction Y (see FIG. 2A). Therefore, the busbar 3 is firmly positioned and held in the up-down direction Z by use of the front held portion 73 assuming the cross shape.

Additionally, the extension portion 6 of the busbar 3 is abutted against an abutting portion (the grooved bottom surface 33*a* of the third holding groove 33) disposed at the front wall surface 16*a* of the front-rear-direction intermediate wall portion 16 as shown in FIG. 8A, FIG. 8B, FIG. 9A, and FIG. 9B. Therefore, it is possible to highly accurately position and hold the busbar 3 in the front-rear direction X by use of the extension portion 6.

Additionally, the extension portion 6 of the busbar 3 is fitted and held by the third holding groove 33 serving as the third holding portion disposed at the front wall surface 16*a* of the front-rear-direction intermediate wall portion 16. The extension portion 6 is positioned and held by the pair of inner wall surfaces 33*b* of the third holding groove 33 in the right-left direction Y, and the extension portion 6 is positioned and held by the grooved bottom surface 33*a* (abutting portion) of the third holding groove 33 in the front-rear direction X. Hence, the busbar 3 is positioned and held in the front-rear direction X and in the right-left direction Y by use of the extension portion 6.

Additionally, the front busbar-housing portion F into which the busbar 3 is inserted and disposed from the front XF is defined by the pair of partition wall portions 18 that face each other in the right-left direction Y and by the ceiling wall portion 11 and the up-down-direction intermediate wall portion 17 (the bottom wall portion 12 and the up-down-direction intermediate wall portion 17) that face each other in the up-down direction Z. The base portions 4 of the busbars 3 housed in the front busbar-housing portions F adjacent in the right-left direction Y are insulated from each other with the partition wall portion 18 interposed therebetween. Therefore, the base portions 4 of the busbars adjacent to each other are prevented from being short-circuited.

Additionally, the pair of guide grooves 30 into which the pair of tips 4*c* in the right-left direction Y of the base portion 4 of the busbar 3 are respectively inserted and guided in the front-rear direction X are formed at the pair of corner portions C that join the pair of partition wall portions 18 and, for example, the up-down-direction intermediate wall portion 17 together.

Therefore, when the busbar 3 is incorporated from the front-insertion-recess-portion-SF side, the pair of tips 4*c* in the right left direction Y of the base portion 4 of the busbar 3 are inserted and guided by the pair of guide grooves 30, and therefore it is possible to easily assemble the relay connector 1.

Additionally, according to the busbar 3, it is possible to provide a busbar that is capable of being suitably used in the relay connector 1, and the relay connector 1 is enabled to fulfill the operational effects mentioned above.

Figure 12:
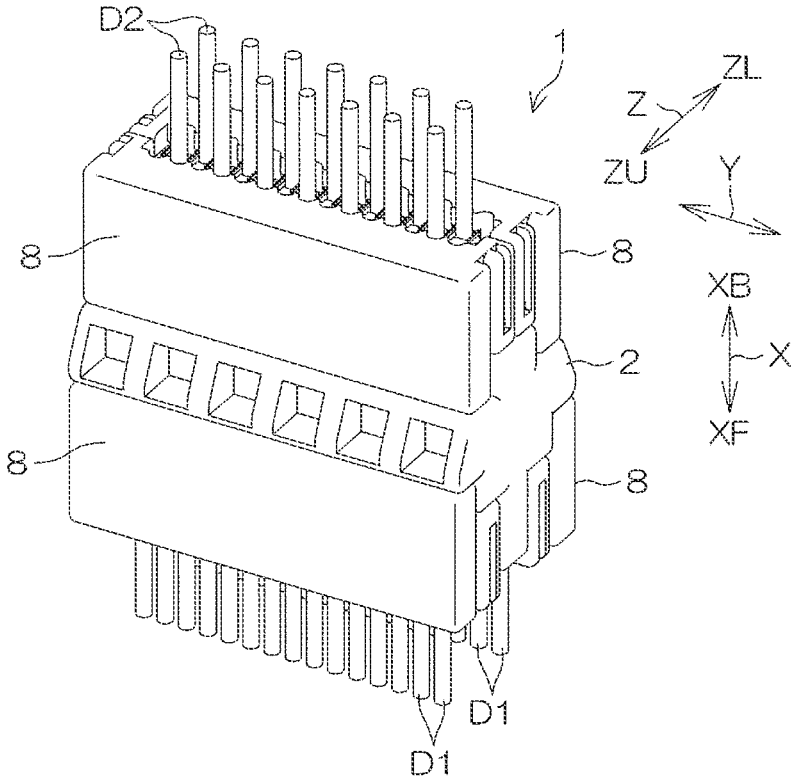
FIG. 12 is a perspective view of the relay connector when a retainer is used.
Figure 13:
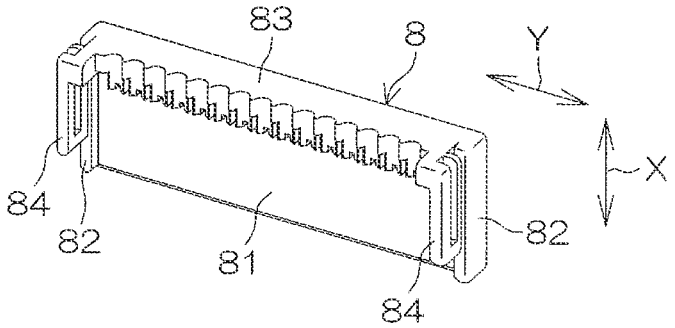
FIG. 13 is a perspective view of the retainer.

Additionally, each of the female terminals (see FIG. 1) may be retained by use of a retainer 8 as shown in FIG. 12. The retainer 8 includes a first wall portion 81, a pair of second wall portions 82, a third wall portion 83, and a pair of elastic hooks 84 as shown in FIG. 13. The first wall portion 81 covers the front and rear portions 11*a* and 11*b* of the ceiling wall portion 11 and the front and rear portions 12*a* and 12*b* of the bottom wall portion 12 (see FIG. 8A), respectively. Additionally, the pair of second wall portions 82 cover a corresponding part of each of the sidewall portions 15. The third wall portion 83 is locked by the main body portions 94 and 97 of corresponding female terminals (see FIG. 1). The elastic hooks 84 are elastically surmounted and locked by corresponding locking projections 15*f* and 15*g*.

The present invention is not limited to the preferred embodiment, and at least one of the upper and lower row busbars 3U and 3L may be configured by a single-specification busbar.

Although the present invention has been described in detail from the concrete aspects, those skilled in the art who have understood the aforementioned contents will easily recognize its modifications, variations, and equivalents. Therefore, the present invention should be within the scope of the claims and the scope of its equivalents.

REFERENCE SIGNS LIST

1 relay connector
2 housing
3 busbar
4 base portion
4*c* tip
5 rear tab
6 extension portion
7 front tab
11 ceiling wall portion
12 bottom wall portion
16 front-rear-direction intermediate wall portion
16*a* front wall surface
17 up-down-direction intermediate wall portion
18 partition wall portion
18*a*, 18*b* protruding portion
19 partially-dividing wall portion
19*a*, 19*b* protruding portion
30 guide groove
31 press-fit hole (first holding portion)
32 second holding groove (second holding portion)
32*a* inner wall surface
33 third holding groove (third holding portion)
33*a* grooved bottom surface (abutting portion)
33*b* inner wall surface
53 rear held portion
54 rear male terminal portion
62 extension end
71 base end portion
71*a* right-left-direction protruding portion
73 front held portion
74 front male terminal portion
91 front female terminal
92 rear female terminal
B rear busbar-housing portion
BLa, BLb (BL) lower-row rear busbar-housing portion
BUa, BUb (BU) upper-row rear busbar-housing portion
C corner portion
F front busbar-housing portion
FLa, FLb (FL) lower-row front busbar-housing portion
FUa, FUb (FU) upper-row front busbar-housing portion
H busbar holding portion
SB rear insertion recess portion
SBL lower-row rear insertion recess portion
SBU upper-row rear insertion recess portion
SF front insertion recess portion
SFL lower-row front insertion recess portion
SFU upper-row front insertion recess portion
X front-rear direction
XB rear side
XF front side
Y right-left direction
Z up-down direction
ZU upward side
ZL downward side

What is claimed is:

1. A relay connector that connects a plurality of front female terminals that are fitted from a front in a front-rear direction and a plurality of rear female terminals that are fitted from a rear in the front-rear direction together, the relay connector comprising a housing and a busbar, the housing including:

a plurality of front insertion recess portions that are disposed so as to be arrayed in a right-left direction and into which the front female terminals are respectively inserted, a plurality of rear insertion recess portions that are disposed so as to be arrayed in the right-left direction and into which the rear female terminals are respectively inserted, an intermediate wall portion that divides the front insertion recess portion and the rear insertion recess portion from each other in the front-rear direction, and a busbar holding portion that is disposed at the intermediate wall portion, the busbar including:

a base portion that extends in the right-left direction, a plurality of rear tabs that extend from the base portion to the rear insertion recess portion, a plurality of extension portions each of which extends from the base portion to a same side in an up-down direction, and a plurality of front tabs each of which extends from an extension end of each of the extension portions to a corresponding one of the front insertion recess portions, wherein each of the rear tabs includes a rear held portion adjacent to the base portion and a rear male terminal portion that is housed in the rear insertion recess portion, wherein each of the front tabs includes a front held portion adjacent to the extension end of the extension portion and a front male terminal portion that is housed in the front insertion recess portion, and wherein the busbar holding portion includes a plurality of first holding portions which respectively hold the rear held portions of the rear tabs, a plurality of second holding portions which respectively hold the front held portions of the front tabs, and a plurality of third holding portions which respectively hold the extension portions.

2. The relay connector according to claim 1, wherein each of the first holding portions includes a press-fit hole that passes through the intermediate wall portion and into which a corresponding one of the rear held portions is press-fitted and fixed.

3. The relay connector according to claim 1, wherein each of the second holding portions includes a second holding groove that is disposed at a wall surface, which is closer to the front insertion recess portion, of the intermediate wall portion and that holds a corresponding one, which has been fitted in the second holding groove, of the front held portions, and the second holding groove is formed in a shape including a pair of inner wall surfaces that face each other in the up-down direction and that position and hold the front held portion in the up-down direction.

4. The relay connector according to claim 3, wherein each of the front held portions includes a pair of protruding portions that protrude to both sides in the right-left direction, and is formed in a cross shape when seen in the up-down direction.

5. The relay connector according to claim 1, wherein each of the third holding portions includes an abutting portion that is disposed at a wall surface, which is closer to the front insertion recess portion, of the intermediate wall portion and against which a corresponding one of the extension portions is abutted.

6. The relay connector according to claim 1, wherein each of the third holding portions includes a third holding groove that is disposed at the wall surface, which is closer to the front insertion recess portion, of the intermediate wall portion and that holds a corresponding one, which has been fitted to the third holding groove, of the extension portions, and the third holding groove is formed in a shape including a grooved bottom surface serving as the abutting portion and a pair of inner wall surfaces that face each other in the right-left direction and that position and hold a corresponding one of the extension portions in the right-left direction.

7. The relay connector according to claim 1, wherein a plurality of the busbars are disposed so as to be arrayed in the right-left direction, the housing includes a plurality of busbar housing portions that are disposed so as to be arrayed in the right-left direction and into each of which a corresponding one of the busbars is inserted and disposed from the front, each of the busbar housing portions is defined by a pair of partition wall portions that face each other in the right-left direction and by a pair of wall portions that face each other in the up-down direction, and the base portions of the busbars housed in the busbar housing portions adjacent in the right-left direction are insulated from each other by the partition wall portion interposed between the base portions.

8. The relay connector according to claim 7, wherein a pair of guide grooves that respectively receive and guide a pair of tips in the right-left direction of the base portion of a corresponding one of the busbars in the front-rear direction are respectively formed at a pair of corner portions that join the pair of partition wall portions and one of the pair of wall portions together.

9. A busbar that is used in a relay connector, the busbar comprising:

a base portion that extends in a right-left direction;

a plurality of rear tabs that extend rearwardly from the base portion in a front-rear direction;

a plurality of extension portions each of which extends from, the base portion to a same side in an up-down direction; and a plurality of front tabs each of which extends from an extension end of each of the extension portions to a front in the front-rear direction, each of the rear tabs including a rear held portion adjacent to the base portion and a rear male terminal portion, and each of the front tabs including a front held portion adjacent to the extension end and a front male terminal portion.

* * * * *